United States Patent [19]

Nevarez

[11] 3,988,860

[45] Nov. 2, 1976

[54] ELECTRIC SWINGING GATE ASSEMBLY

[75] Inventor: Paul H. Nevarez, Bloomington, Ill.

[73] Assignee: Lawrence Peska Associates, Inc., New York, N.Y. ; a part interest

[22] Filed: Apr. 4, 1975

[21] Appl. No.: 564,983

[52] U.S. Cl. ..... 49/396; 49/327

[51] Int. Cl.[2] ..... A10K 3/00

[58] Field of Search ..... 49/334, 396, 427, 326, 49/327, 358; 256/10

[56] References Cited

UNITED STATES PATENTS

| | | | |
|---|---|---|---|
| 1,243,931 | 10/1917 | Greene | 49/396 |
| 3,775,906 | 12/1973 | Dougherty | 49/427 |

*Primary Examiner*—Thomas F. Callaghan
*Assistant Examiner*—Doris L. Troutman

[57] ABSTRACT

An electric swinging gate assembly comprises a gate section hingably mounted onto a vertical post of the fence. An electric motor having a horizontal drive shaft is mounted onto the gate section, wherein a first pulley member is mounted on the free end of the horizontal drive shaft. A second pulley member and a large wheel are mounted on a horizontal axle rod, wherein the ends of the rod are rotatably contained in bearing assembly mounted on the bottom ends of vertical bars of the gate section. The large wheel engages the ground such that the electric motor causes the wheel to rotate, wherein the gate section can be swung open or closed. Alternatively, an end vertical rod of the gate section can be rotatably mounted in bearing assemblies communicating with the vertical end post of the fence. An electrical motor having a vertical drive shaft is mounted on the fence. A first pulley is contained on the vertical drive shaft and a second pulley is contained on the upper end of the end vertical rod, wherein a pulley belt communicates between the first and second pulley.

1 Claim, 3 Drawing Figures

ELECTRIC SWINGING GATE ASSEMBLY

SUMMARY OF THE INVENTION

My present invention relates to a unique and novel swinging gate assemblies, wherein the gate section is swung open and close by electromechanical means.

A number of U.S. patents: U.S. Pat. Nos. 3,119,310; 3,129,936; and 3,195,879 have employed means for opening and closing doors, but these aforementioned patents are non-applicable to my present invention.

An object of my present invention is to provide an electromechanical means for easily swinging open and close a gate section of a fence, wherein the electromechanical means can be operated by switch or remote control means.

A further object of my present invention is to provide a swinging gate assembly of relatively simple design and relatively low manufacturing cost.

Briefly, my present invention comprises a gate section hingably mounted onto a vertical post of the fence. An electric motor having a horizontal drive shaft is mounted onto the gate section, wherein a first pulley member is mounted on the free end of the horizontal drive shaft. A second pulley member and a large wheel are mounted on a horizontal axle rod, wherein the ends of the rod are rotatably contained in bearing assembly mounted on the bottom ends of vertical bars of the gate section. The large wheel engages the ground such that the electric motor causes the wheel to rotate, wherein the gate section can be swung open or closed. Alternatively, an end vertical rod of the gate section can be rotatably mounted in bearing assemblies communicating with the vertical end post of the fence. An electrical motor having a vertical drive shaft is mounted on the fence. A first pulley is contained on the vertical drive shaft and a second pulley is contained on the upper end of the end vertical rod, wherein a pulley belt communicates between the first and second pulley.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
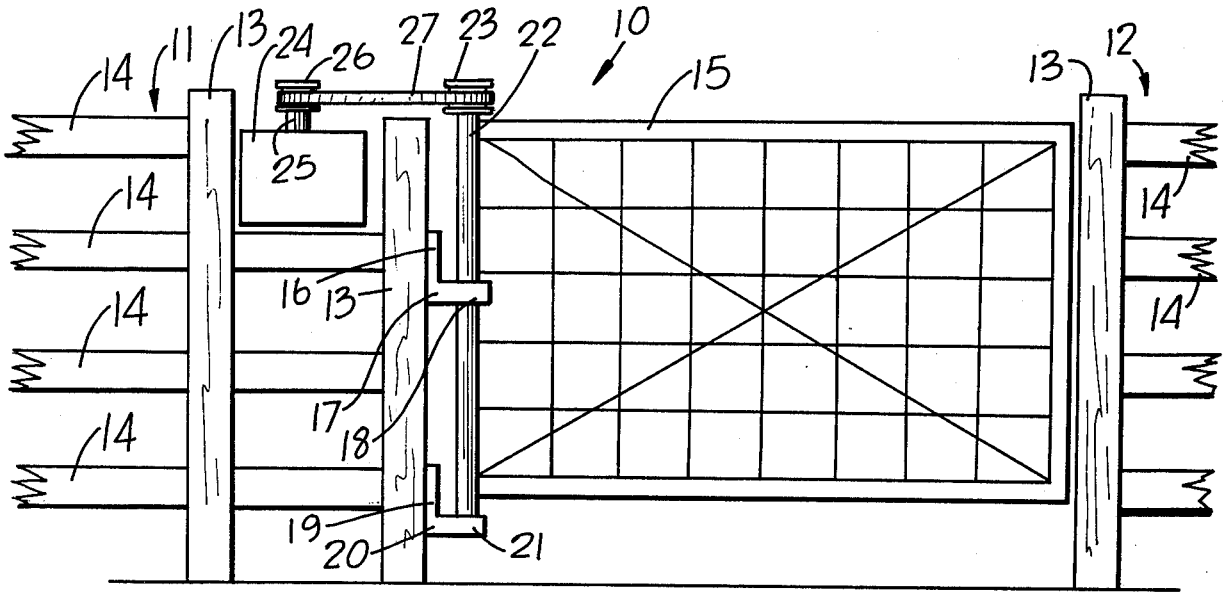
FIG. 1 illustrates a front elevated view of a first type of opening and closing swinging gate assembly.
Figure 2:
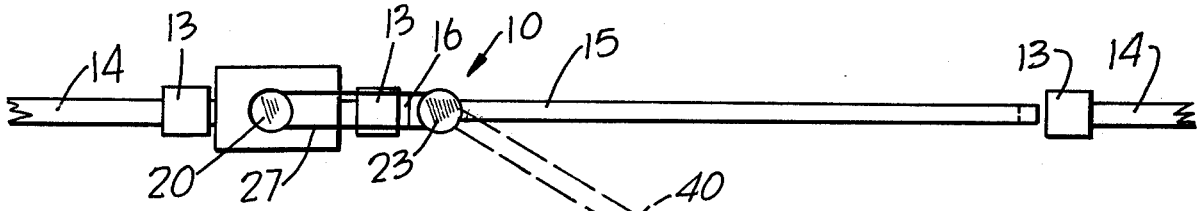
FIG. 2 illustrates a top view of the first type of opening and closing swinging gate assembly.

Turning now descriptively to the drawings, in which similar reference characters denote similar elements throughout the several views, FIGS. 1–2 show a first type of opening and closing swinging gate assembly 10. The swinging gate assembly 10 consists of two sections 11, 12 of a fence having a space between them. Each fence section 11, 12 consists of a plurality of vertical posts 13 and horizontal cross bar members 14. A rectangular shaped gate section 15 hingably communicates with an end vertical post 14. A ball bearing collar 16 is mounted centrally onto the vertical end post 13, wherein the collar 16 is an L-shaped configuration. The horizontal portion 17 of said collar 16 has a bore 18 therethrough, wherein a bearing assembly is contained in bore 18. A ball bearing cup 19 is mounted near the bottom end of the vertical end post 13. The cup 19 is of an L shaped configuration. The horizontal part 20 has a hole 21 in a top face thereof, wherein a ball bearing assembly is contained in the hole 21. The gate section 15 has an end vertical rod 22, wherein rod 22 extends through collar 16 and rotatably engages cup 19. A first pulley 23 is affixed onto the upper end of rod 22. An electrical motor 24 having an upward extending vertical drive shaft 25 is mounted on top of a middle cross bar member 14, wherein the electrical motor 24 is reversible. A second pulley 26 is affixed onto the upper free end of drive shaft 25. A horizontal pulley belt 27 communicates between pulleys 23, 26. As the drive shaft 25 rotates, the pulley belt translates the rotational energy to rod 22, which rotates within collar 16 and cup 19 causing the gate 15 to either swing open or close as shown by phantom lines 40.

Figure 3:
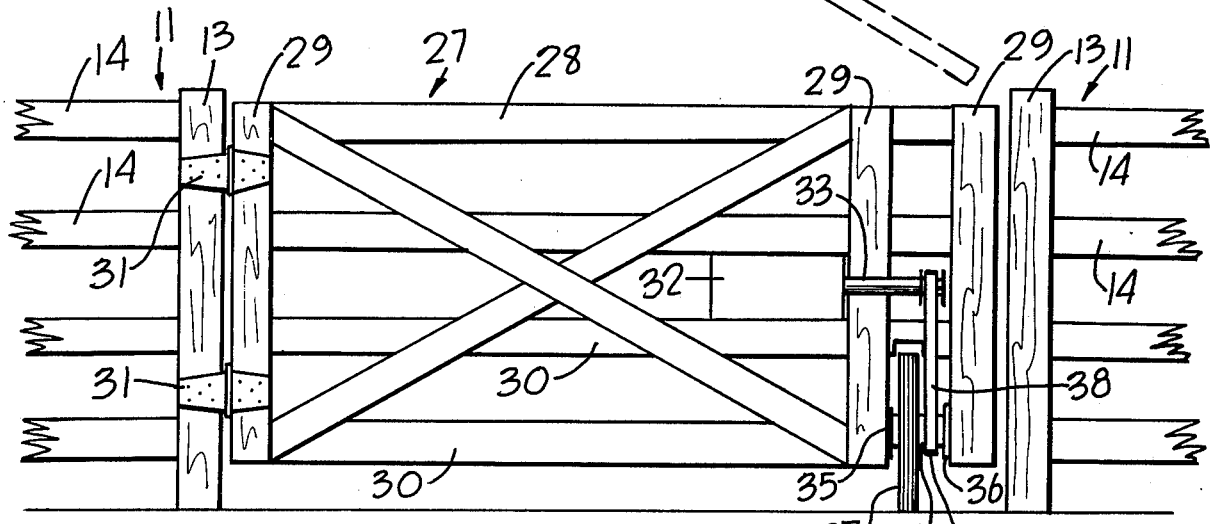
FIG. 3 illustrates a front elevated view of a second type of opening and closing swinging gate assembly.

FIG. 3 shows a second type of opening and closing swinging gate assembly 27. The rectangular shaped gate 28 consists of vertical bars 29 and horizontal cross bars 30, wherein an end vertical bar 29 is hingably mounted to an end vertical post 13 of one section 11 of the fence by a pair of hinges 31. An electric motor 32 having a horizontal drive shaft 33 is mounted onto the gate 28, wherein a first pulley member 41 is affixed to the free end of the horizontal drive shaft 33. The ends of a horizontal axle rod 34 are contained in a pair of bearing assemblies 35, 36 mounted on the bottom ends of two vertical bars 29. A second pulley member 37 is contained on rod 34, wherein a pulley belt member 38 communicates between the pulley members 37, 41. A large wheel member 39 is mounted onto rod 34, wherein wheel member 39 engages the ground. As the wheel member 39 rotates, and moves along the ground, the gate 28 swings open or close depending upon the direction of rotation of the horizontal drive shaft 33.

Hence, obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by Letters Patent of the United States is:

1. An improved swinging gate assembly for a fence having an end vertical post and a rectangularly shaped gate section having an end vertical rod, which comprises:

a. a ball bearing collar mounted centrally on said vertical post, said vertical rod of said gate section journaled through said bearing collar;

b. a ball member cup mounted near a bottom end of said vertical end post, a lower end of said vertical rod journaled for rotation in said bearing cup;

c. an electrical motor having an upwardly extending vertical drive shaft mounted in said fence, said vertical drive shaft extending just above an upper end of said vertical post;

d. a first pulley mounted on an upper end of said vertical end rod;

e. a second pulley mounted on an upper end of said vertical drive shaft; and f. a horizontal pulley belt cooperating between said first and said second pulley.

* * * * *